United States Patent [19]

Beamer

[11] Patent Number: 4,993,877

[45] Date of Patent: Feb. 19, 1991

[54] METHOD AND APPARATUS FOR FORMING A TRENCH

[75] Inventor: John V. Beamer, Atlanta, Ga.

[73] Assignee: Construction Casting Company, Atlanta, Ga.

[21] Appl. No.: 103,678

[22] Filed: Oct. 2, 1987

[51] Int. Cl.[5] ..... E02B 5/00

[52] U.S. Cl. ..... 405/282; 249/10; 405/118

[58] Field of Search ..... 405/36, 282, 283, 118, 405/119; 249/1, 10, 11; 404/2, 3, 4

[56] References Cited

U.S. PATENT DOCUMENTS

| | | | |
|---|---|---|---|
| 786,305 | 4/1905 | McIntyre | 249/11 |
| 1,562,780 | 11/1925 | Mickelson | 249/11 |
| 2,938,437 | 5/1960 | Daley | 404/4 |
| 3,299,785 | 1/1967 | James | 404/4 |
| 3,362,167 | 1/1968 | Ward | 405/282 |
| 3,625,011 | 12/1971 | Stevenson | 405/36 |
| 4,472,078 | 9/1984 | Karbstein | 404/2 |

*Primary Examiner*—David H. Corbin

*Attorney, Agent, or Firm*—Needle & Rosenberg

[57] ABSTRACT

A method and apparatus for constructing a grate or solid covered trench is provided, having a "Z" type frame made positionally adjustable by an adjustment slot and fastening means combination, and a trench-form construction achieving stability by means of a number of box-shaped bracings positioned along the trench-form sidewalls. The positions of the bracings are staggered to provide both a supporting surface to the frame and stability to the lower regions of the sidewalls.

21 Claims, 8 Drawing Sheets

FIG. 1
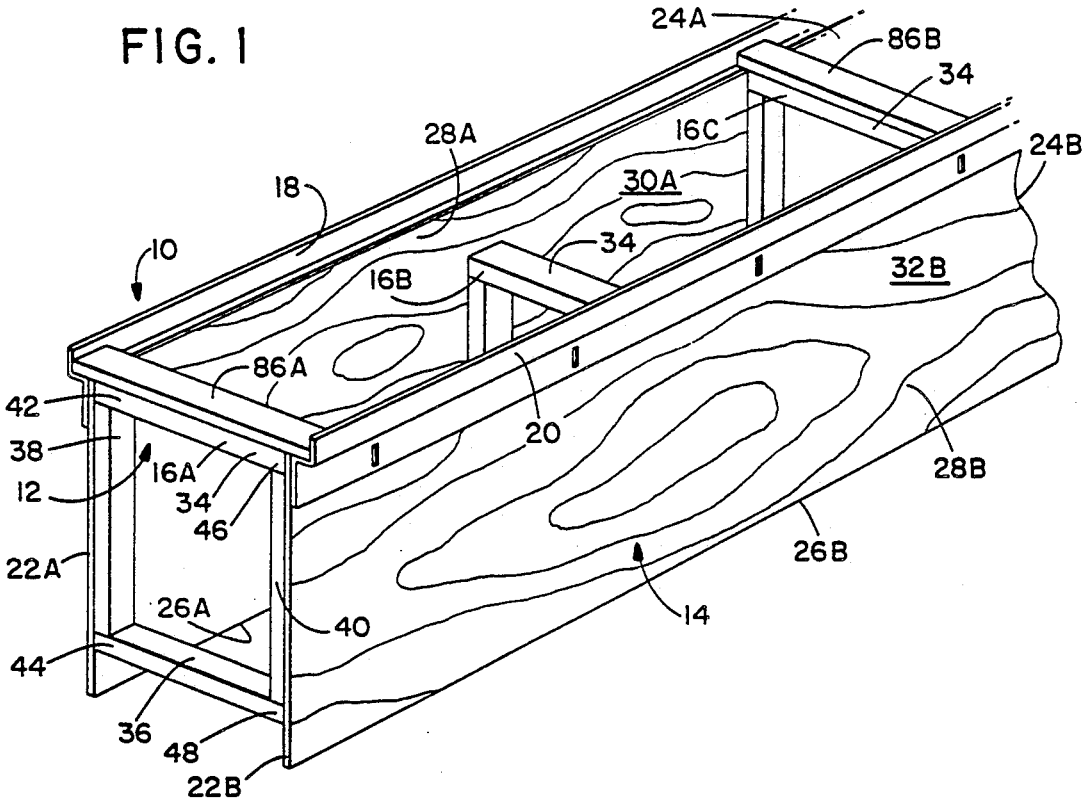
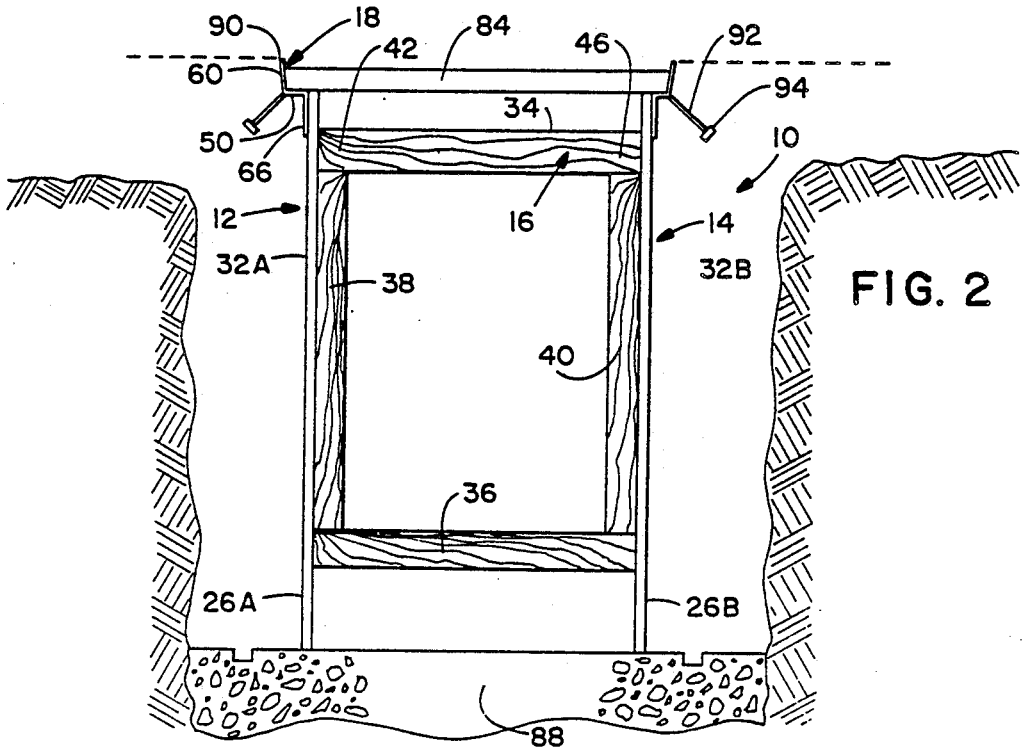
FIG. 2

METHOD AND APPARATUS FOR FORMING A TRENCH

BACKGROUND OF THE INVENTION

The present invention relates to the construction industry, and more particularly to the formation of a grate-covered trench including an assembly for forming the trench and a novel frame for the assembly.

The use of concrete-lined grate or solid covered trench hereafter called a grate is well known in road, parking lot, and other constructions. The typical trench construction includes a pair of spaced frames, each having a grate supporting surface upon which a metal grate rests. A major problem exists, however, in that in construction, the grate supporting surfaces of the frames must be on a common lateral plane so as to prevent rocking of the grate when a car or other heavy object passes over the trench.

The most common current method of forming a grate-covered trench recognized the need for positioning the frames to provide a properly set grate. A floor slab of the trench is prepared and cured, and a box-like form is placed inside. The form typically has a pair of parallel plywood sidewalls, each corresponding to a trench wall, extending vertically from the floor to the final grade elevation. A number of spreaders, typically consisting of wooden joists, are fastened atop the sidewalls for providing a stop for a frame and seat form. Also, inner bracing is used, consisting of wooden studs attached to the upper edge of a first sidewall at one end and to the lower edge of the second sidewall on the other. A criss-crossed pattern of bracing is achieved by altering the sidewall upper edge upon which the stud is attached. The frame typically consists of an elongate bar having an L-shape when viewed cross-sectionally.

A horizontal grate-supporting surface is provided, upon which an edge of the bottom of the grate rests, and a vertical back surface is provided for contacting the side edges of the grate. The seat form has dimensions identical to the frame, the back surface height and grate supporting surface width of the frame corresponding to the height and width of the seat form. A seat form is attached to the upper edge of the outside surface of each sidewall, and the frame is attached so that the back surface and grate supporting surface contact the seat form, thereby assuring that the frame is at the desired elevation and level. An inner joist is typically placed along the upper edge of the inner surface o each sidewall opposite the seat forms. The frame is typically attached to the seat form with nails or other fasteners.

To hold the frame at the required plane, a hole is provided in the sidewall at a point below the frame, and a 9 gauge wire is placed through the hole and brought over the top of the frame sidewall and inner joist. The two ends of the wire are then intertwined, thereby tightening the frame into position. Adjusting the tension on the wire allows the repositioning of the frame as required. A series of such wire-operated frame positioning means are required along the length of the frame. Only after the entire frame is properly positioned can concrete be poured outside the sidewalls, thereby forming the trench and holding the frame in final place.

It can be seen that this procedure is complicated and involves many steps requiring great attention to detail. Because the frame-positioning means must be constantly adjusted, the construction of trenches using this method is time consuming and, therefore, expensive.

Skilled personnel are required to properly position the frames or the grate will not sit properly and the procedure must be repeated from start. Additionally, the need to be able to repeatedly maneuver the frame dictates that the frame be kept to a relatively short length (i.e., approximately two or three feet). Otherwise the frame would be too heavy and could not be moved by manipulation of the wire. This results in a large number of joints along the length of the trench between individual frame sections, thereby resulting in less than optimal stability.

Therefore, there exists a need for an improved method for producing a grate-covered trench.

There also exists a need for such a method of installation which is simple, relatively quick, and which does not require skilled labor.

There exists a further need for such a method which will allow the use of frames of relatively long length, thereby reducing the number of joints along the trench.

There exists a still further need for an improved frame which can be used in the above-mentioned methods.

SUMMARY OF THE INVENTION

The disadvantages of the prior art are overcome by the present invention which relates to a procedure for forming a grate-covered trench, as well as a frame used in such procedure.

A floor slab is poured along the bottom of an elongate trench. A trench form is built comprised of a pair of spaced, vertically oriented plywood sidewalls separated and held in relative stable, parallel position by a series of box-like bracings attached to the interior surfaces of both sidewalls. The bracings are preferably made from 2×4's, and their number is a function of the height and depth of the trench form, as well as the potential pressure exerted by concrete poured against the outside of the wall. It has been found that optimum stability can be achieved by varying the placement of the bracings lengthwise along the trench. That is, the bracings are alternated from a first position in which the upper surface of a bracing is flush with the upper edge of the plywood walls, and a second position in which the bracing is attached lower along the walls so as to give extra support to the bottom portion of the form.

A pair of adjustable frames for maintaining a grate in stable position along the trench are also provided. Each frame is preferably "Z"-shaped, in that it comprises a horizontally oriented rectangular grate support member, an upper grate contacting member extending vertically upward from the top, rear edge of the grate support member, and a sidewall contacting surface extending vertically downward from the bottom, forward edge of the grate support member. The sidewall contacting surface has along its bottom edge a number of vertically extending adjustment slots.

To attach the frame to the sidewall, a hole is drilled through the sidewall at a point corresponding to the location at the midpoint of each adjustment slot. The frame is positioned so that the sidewalls contacting member is against the outside surface of the sidewall, the forward edge of the grate supporting member being flush against the upper edge of the sidewall. A bolt is placed though each hole and slot combination, preferably from the inside of the frame and a nut is placed at the opened end of the bolt to serve as a cap. The frame is thereby supported in position by the bolt. A second frame is similarly attached to the opposite sidewall.

To obtain the desired level grate orientation, a workman merely positions a grate or a flat piece of material the approximate length and width of a grate on the grate supporting members of the frames, and determines the required degree of vertical adjustment along the length of each frame. Each frame is then adjusted vertically as necessary by sliding the frame along the bolt through the slot, and, upon achieving the desired position, the bolt is tightened to the nut. This serves to firmly secure the frame against the sidewall, whereafter a spreader bar is placed between the frames to hold the frames at correct width, and concrete can be poured along the outside of the trench form to provide the finished product.

It can be seen, therefore, that the procedure, including its new frame design, can be used to quickly form a grate covered trench. The use of wire as a positioning means is eliminated, as is the large number of steps associated with such method. Also, because the method is simple, the need for skilled personnel is eliminated. Furthermore, the frames used in the present method, due to the unique leveling technique, can be of longer length than those presently in use. As a result, less joints appear in the final product, resulting in increased stability and greater load capacity. Additionally, spalling of the surrounding concrete is greatly reduced, further increasing stability and load capacity. Another important benefit of the technique of the present invention is that the use of longer frames acts to straighten the sidewalls, which in turn results in a more stable, and optimally leveled final product.

It can be seen, therefore, that it is an object of the present invention to provide an improved method for producing a grate-covered trench.

It is also an object of the present invention to provide a method of installation which is simple, quick, and does not require skilled labor.

It is a further object of the present invention to provide such a method which allows the use of frames of relatively long length and "Z"-shape which results in a reduction of concrete spalling.

It is also an object of the present invention to provide a frame which can be used in the above-mentioned methods

BRIEF DESCRIPTION OF THE FIGURES OF THE DRAWINGS

FIG. 1 is a perspective view of a trench-form assembly of the present invention;

FIG. 2 is a cross-sectional view of a completed trench-form assembly of the present invention;

DETAILED DESCRIPTION OF THE PREFERRED EMBODIMENT

Figure 3:
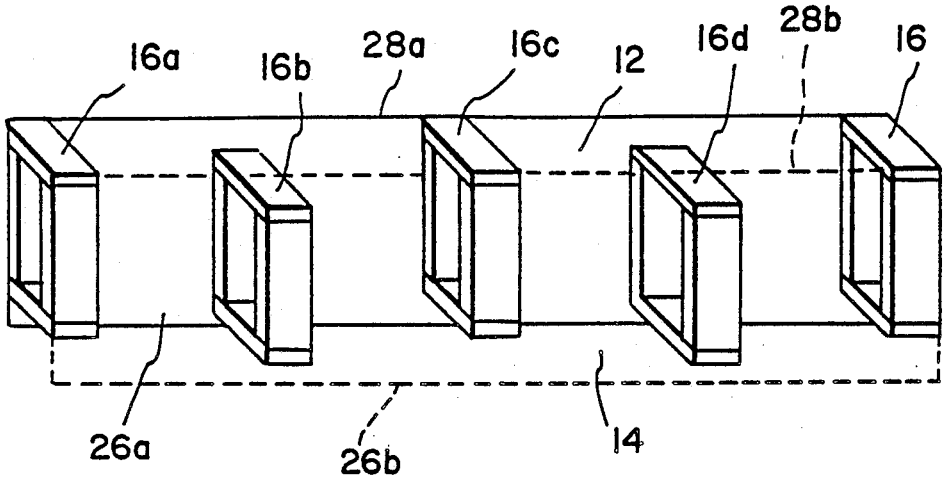
FIG. 3 is a perspective view of the bracings used in the trench-form assembly of the present invention with one sidewall shown in phantom lines.
Figure 11:
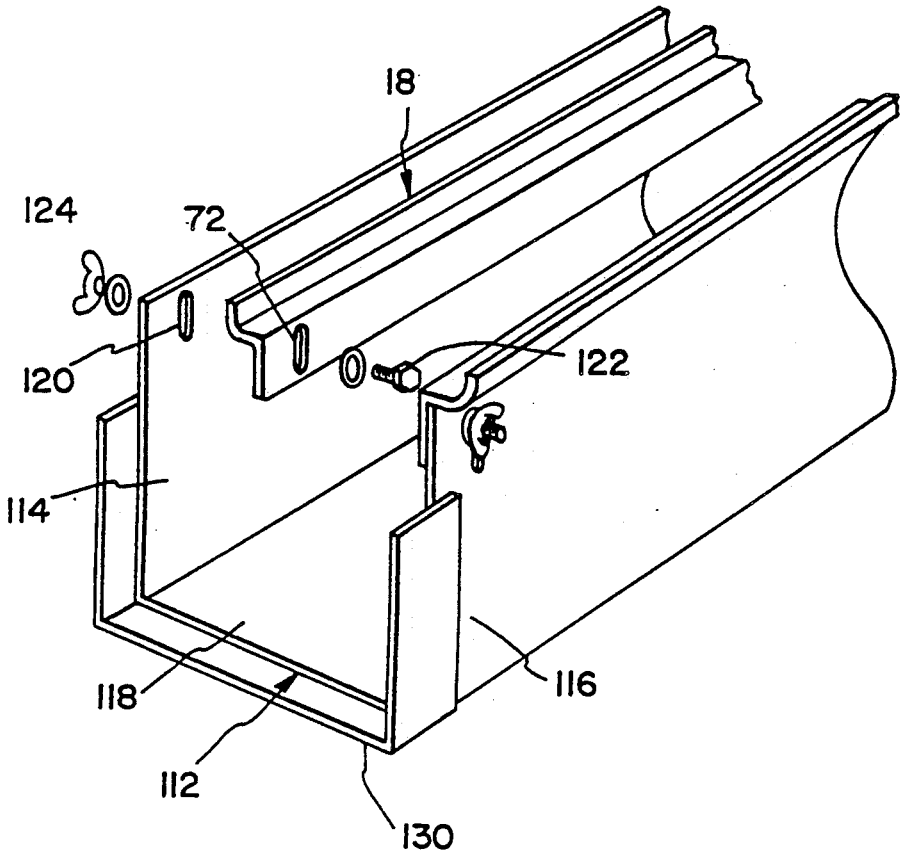

Referring to FIGS. 1 and 2, a trench form assembly 10 is constructed for providing the initial framework of the grate-covered trench. The trench form 10 is comprised of a pair of parallel sidewalls 12, 14 maintained in spaced, vertical relationship by a number of box-like bracings 16*a, b, c.* A pair of frames 18, 20 for holding a grate in stable position are attached atop the sidewalls 12, 14.

Each sidewall 12, 14 is preferably a rectangularly shaped piece of three-quarter inch thick weather resistant plywood, having a forward side edge 22*a,b* a rearward side edge 24*a,b,* a bottom edge 26*a,b,* a top edge 28*a,b* an inner surface 30i a,b, and an outer surface 32*a,b.* The bracings 16*a,b,c* are 7 preferably made of wooden 2×4's, and are present to provide support to the assembly 10 when concrete is poured outside the sidewalls 12, 14. Each bracing 16*a,b,c* is comprised of an upper horizontal bracing member 34 of a length equal to the distance between the sidewalls 12, 14, a lower horizontal bracing member 36 of length equal to that of the upper bracing member 34 and first and second vertical bracing members 38, 40 equal in length to the desired distance between the upper and lower bracing members 34, 36, but preferably shorter than the height of the sidewalls 12, 14. The first vertical bracing member 38 is placed between and attached to a first end 42 of the upper bracing member 34 and a first end 42 of the lower bracing member 36 so as to form a first to form a first planar attachment surface. The second vertical bracing member 40 is placed between and attached to the end opposite the first end 46 of the upper bracing member 34 and the end 48 opposite the first end 44 of the lower bracing member 36 so as to form a second planar attachment surface. Nails or other fastening means may be used to hold the completed bracing 16 together.

As illustrated in FIG. 3, it is preferable that a number of bracings 16*a–e* be spaced between the sidewalls 12, 14. Attachment can be accomplished by nailing or other fastening means. It is also preferable that the vertical position of the attached bracings 16*a–e,* along the sidewalls 12, 14 be staggered so that the bracings 16*a–e* along the sidewall forward side edge 22 and rearward side edge 24 are flush with the sidewall top edges 28*a,b* and every second bracing 16*b,d* thereafter is attached lower along the walls 12, 14 to give extra support to the bottom of the form 10.

For example, it has been found that positioning the lower bracings 16*b,d* approximately three inches above the bottom edge 26*a,b* of the sidewalls 12, 14 will provide the proper support to the assembly 10. Such support at the lower region of the sidewalls 12, 14 is critical because that area is subjected to a greater amount of pressure than the upper region when concrete is poured around the assembly 10. If more than four bracings 16 are used in a single assembly 10, it is recommended that at least one inner bracing 16*c* also be positioned flush with the sidewall top edges 28*a,b* to provide a supporting surface for the frames 18, 20. The number of bracings 16 required per trench-form assembly 10 is a function of height, depth and potential concrete pressure along the outer surfaces 32*a,b* of the sidewalls 12, 14.

Once the bracings 16 are attached, the frames 18, 20 are connected to the sidewalls 12, 14. The frames 18, 20 serve as a supporting means for a grate placed over the trench. It is desired that the grate be as level as possible so as to not move when a vehicle crosses over it. To achieve such, the frames 18, 20 must be properly positioned.

Figure 4:
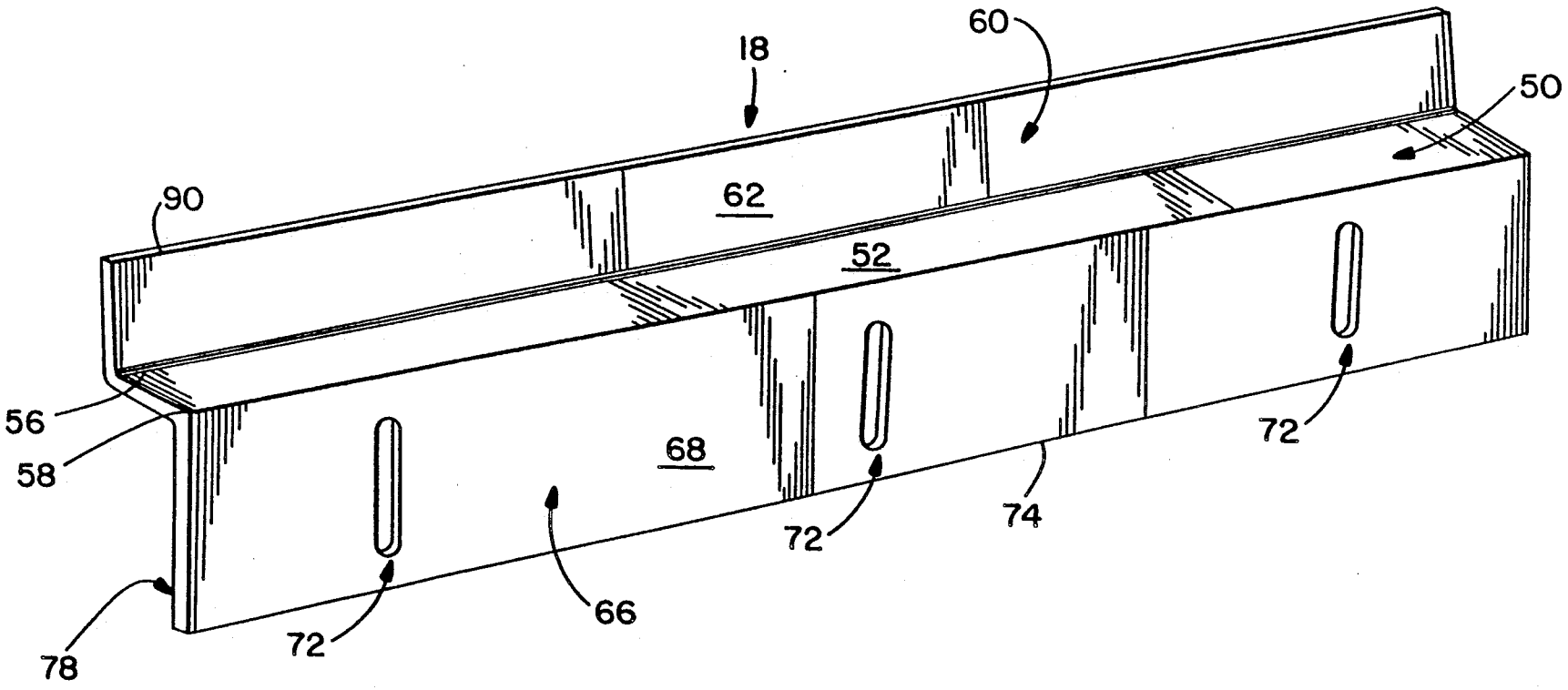
FIG. 4 is a perspective view of the frame of the present invention.
Figure 5:
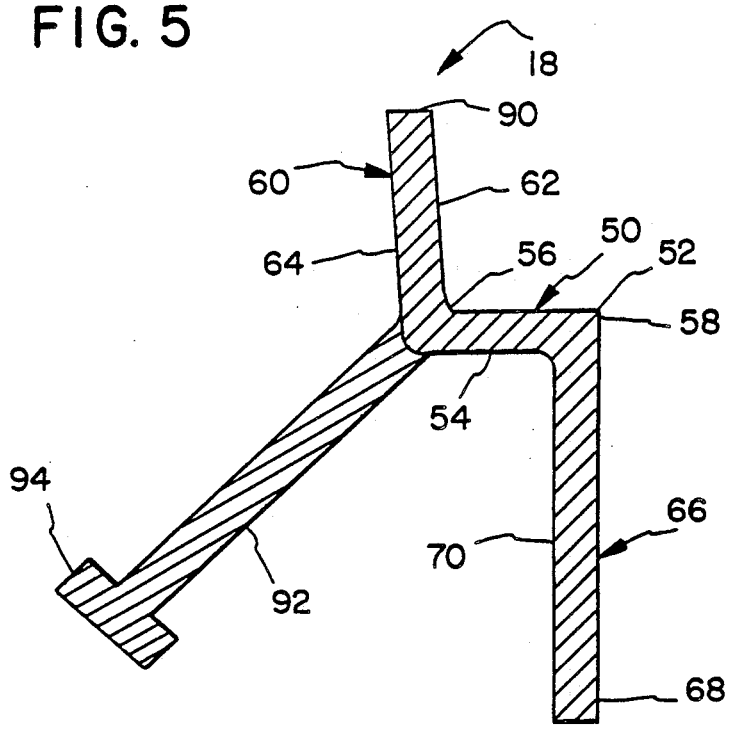
FIG. 5 is an end view of the frame of the present invention.

Each frame 18, 20 is made of a hard material, preferably galvanized steel, and is "Z"-shaped in cross section. Frame 18 as seen in FIGS. 4 and 5, has a rectangularly shaped and horizontally oriented grate supporting member 50, which has a planar top surface 52, a bottom surface 54 opposite the top surface 52, a rearward edge 56 and a forward edge 58 opposite the rearward edge 56. A rectangular upper grate contacting member 60 is also provided, extending vertically upward from the top surface 50 of the grate supporting member 50 along the supporting member's rearward edge 50, and having a front surface 62, a rear surface 64, and an upper edge 90. The upper grate contacting member 60 preferably runs along the entire length of the supporting member 50.

A sidewall contacting member 66 is also provided, extending vertically downward from the bottom surface 54 of the grate supporting member 50 forward edge 58, and having a front surface 68 and a rear surface 70. Preferably, the sidewall contacting member 66 also runs along the entire length of the supporting member 50. The sidewall contacting member 66 also contains a plurality of adjustment slot 72 beginning at its lower edge 74 and extending approximately halfway up the member 66. Each slot 72 is preferably 5/16 inch in width. The frame 20 is identical in construction to frame 18.

Figure 6:
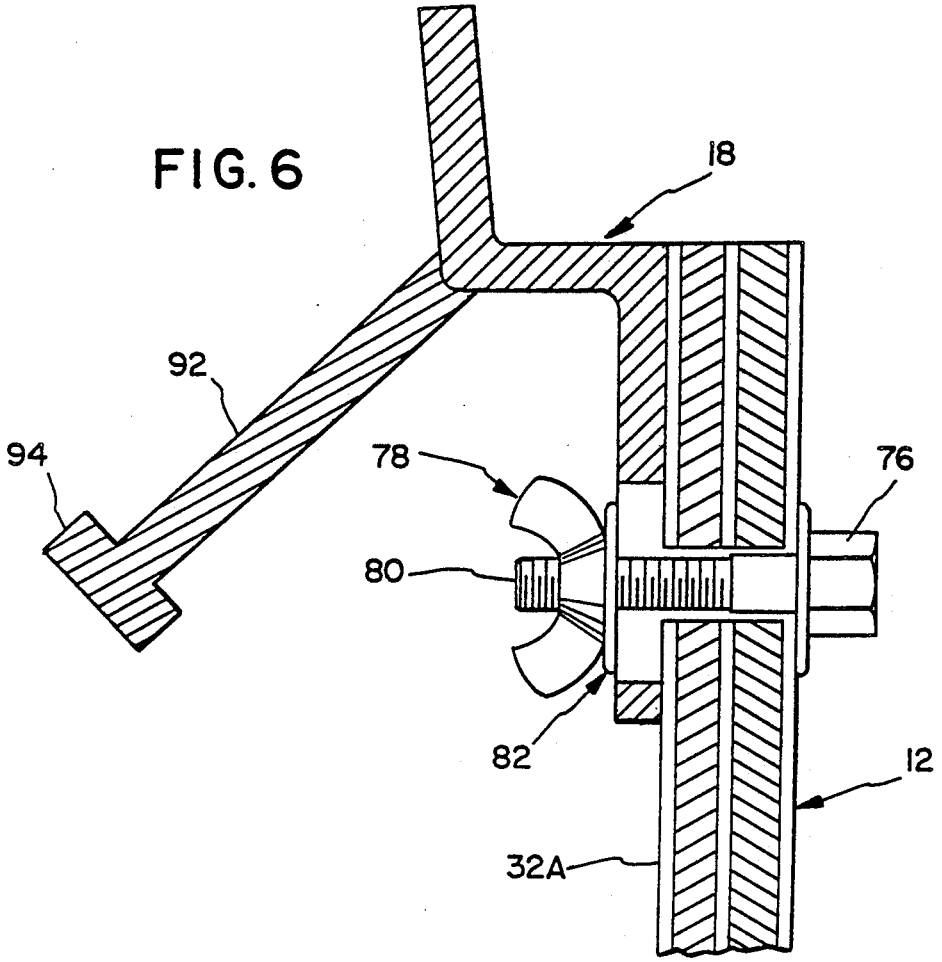
FIG. 6 is a cross-sectional view of the frame of the present invention as attached to the sidewall of a trench-form assembly.
Figure 7:
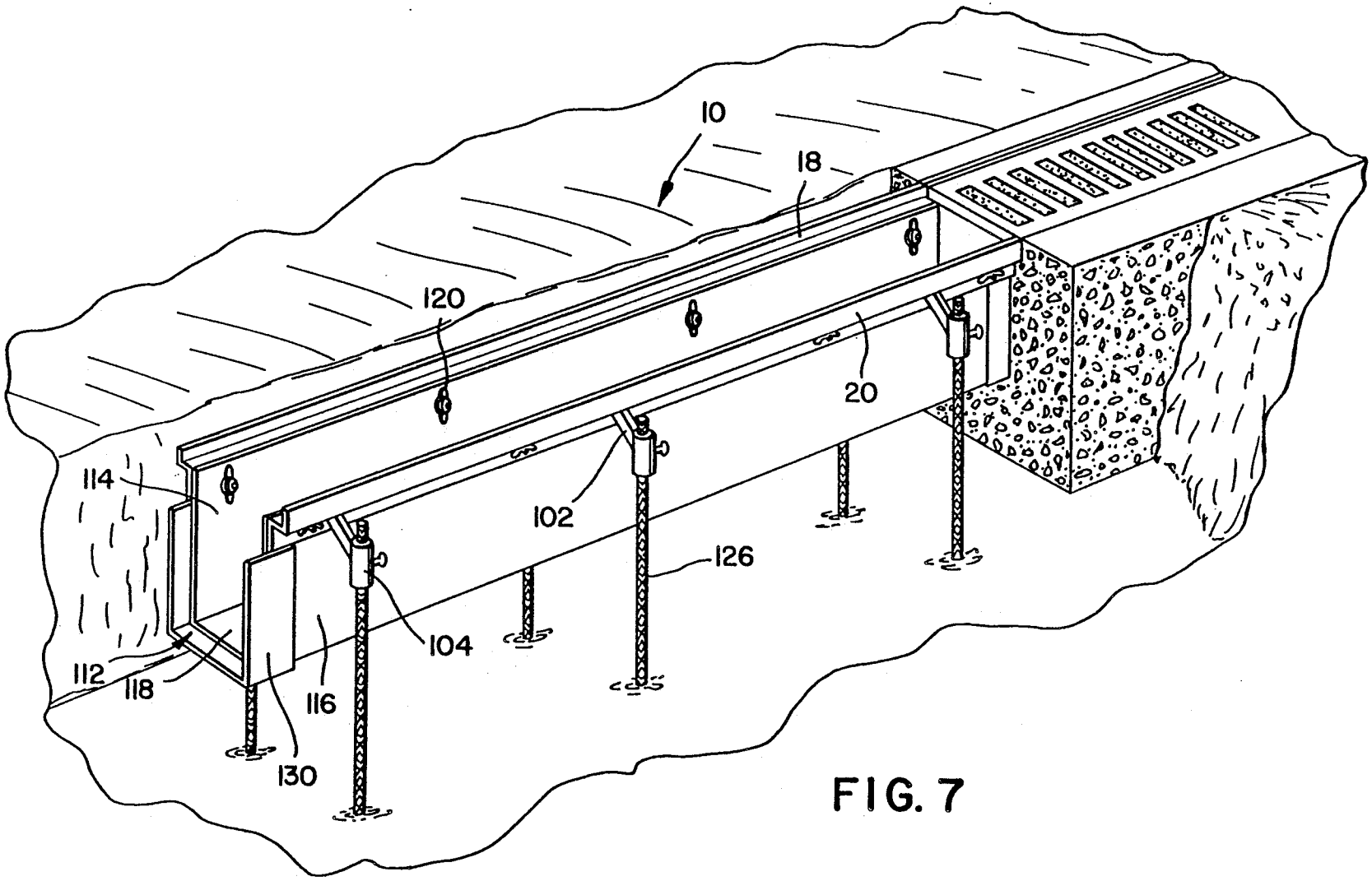
Figure 8:
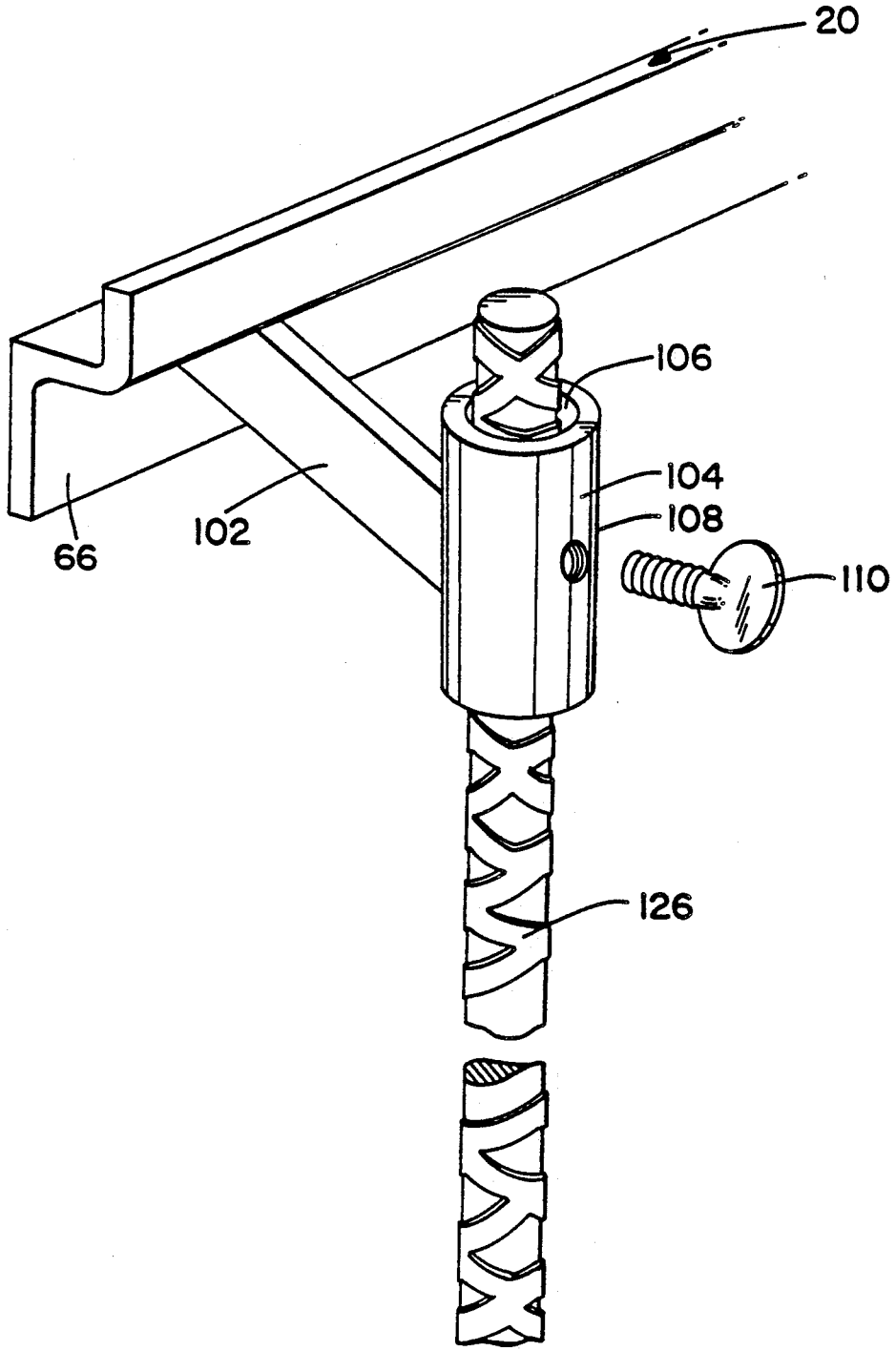
Figure 9:
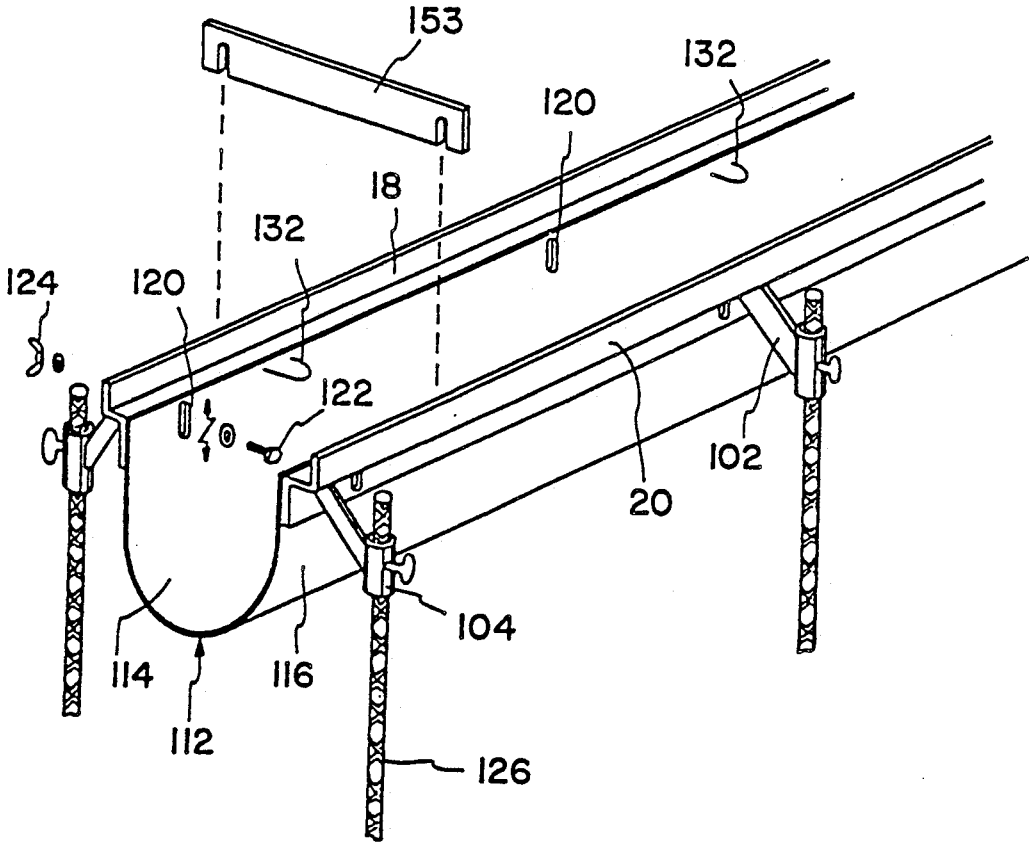
Figure 10:
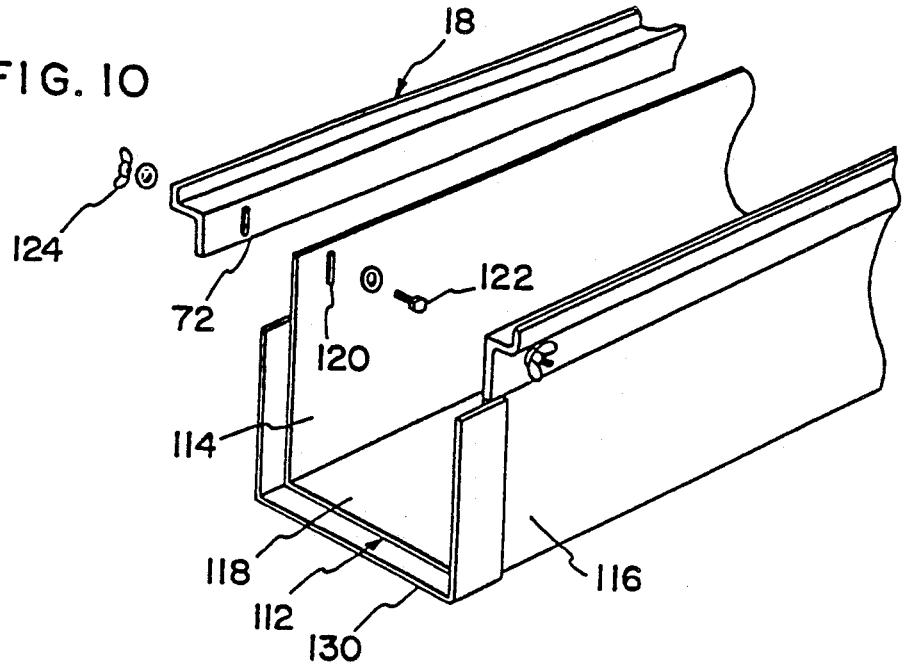
Figure 12:
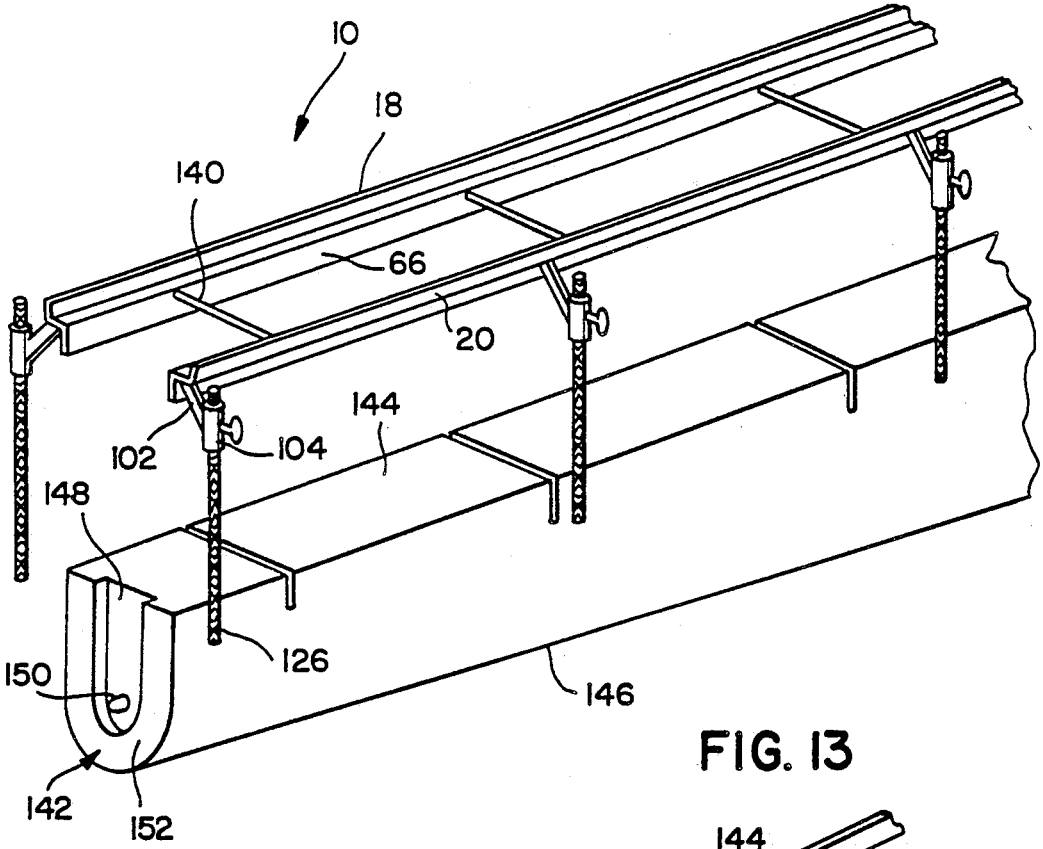
Figure 13:
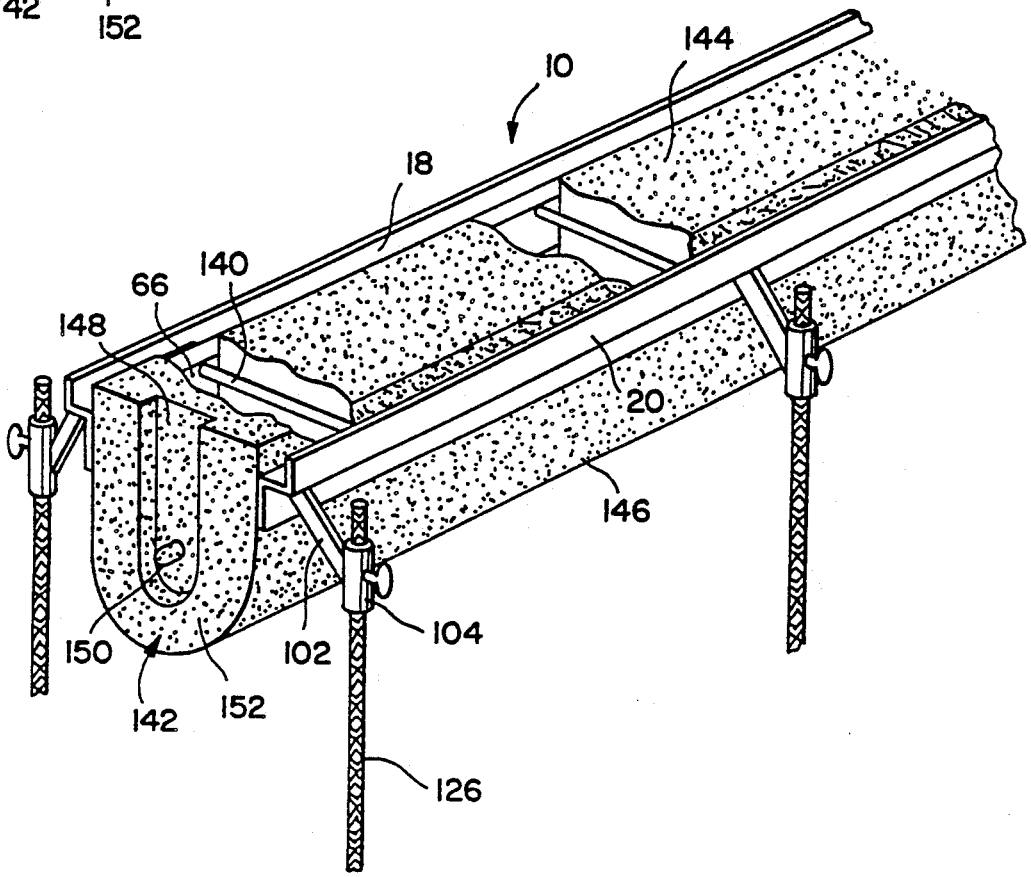

To attach the frames 18, 20 to their respective sidewall 12, 14, the first frame 18 is positioned so that the front surface 68 of the sidewall contacting member 66 is against the outer surface **32*a* of the sidewall 12, and the top surface 52 of L the grate supporting member 50 is flush with upper edge 28*a* of the sidewall 12. With a pencil or other indication means, each adjustment slot 72 is traced on the outer surface 32*a* of sidewall 12. A hole, preferably one-quarter inch in diameter, is then drilled at approximately the midpoint of each tracing. A bolt 76, as shown in FIG. 6, having a diameter slightly smaller than the width of the slot 72 is placed through each hole and adjustment slot 72 of the frame 18. A nut 78 is placed on the open end 80 of each bolt 76. It is preferable that washers 82 be placed between the nut 78 and the outer surface 32*a* of the sidewall 12 for proper fastening. While the frame 18 is in desired position, the nut 78 on the endmost bolt 76 is firmly tightened. Next, the intermediate nuts 78 are tightened just enough to hold the frame 18 in place. After assuring that the frame 18 is still in proper anticipated position, the nut 78 on the remaining endmost bolt 76 is firmly tightened. Finally, the intermediate nuts 78 are firmly tightened to secure the frame 18 in place. Frame 20 is there after attached in similar fashion to the opposite sidewall 32*b*. It is noted that the frames 18, 20 may be attached to the sidewalls 12, 14 either before or after the bracings 16 are attached to the sidewalls 12, 14**.

It is commonplace, regardless of the procedure and frame-type used, to have to adjust the positions of the frames 18, 20 to achieve a properly set grate. To test for proper frame 18–20 positioning, a flat piece of material the length and width of a grate, including the grate 84 itself as shown in FIG. 2, is placed atop the frames 18, 20 in the desired anticipated position. Any deviation from proper position will result in rocking or other movement of the grate 84. To adjust the frames 18, 20 in the present invention, one simply loosens the nuts 78, repositions the frame 18, 20 vertically along the slots 72 until the grate 84 is properly set, and retighten. After leveling is completed, the grate is removed and spreader bars **86*a*, 86*b*, as shown in FIG. 1, are fastened to the top of all the upperly positioned bracings 16*a,c,d* to hold the frames 18, 20 at correct width which is generally the width of the grate 84** plus three-sixteenth inches).

Once properly assembled, the trench-form assembly 10 is positioned within the U-shaped trench as shown in FIG. 2. It is preferable that a concrete floor slab 88 be prepared at the floor of the trench before the assembly 10 is positioned. Once the assembly 10 is in place, concrete is poured outside the assembly 10 so as to fill in the area between the assembly sidewalls 12, 14 and the trenchwalls. Also, concrete or other material may be laid over the surface of the ground surrounding the assembly 10 to a level corresponding with and contacting the upper edge 90 of the upper grate contacting member 60, as illustrated by the phantom lines in FIG. 2. The concrete acts, upon curing, to hold the assembly 10, and particularly the frames 18, 20, in a final position assuring a properly set grate 84. The grate 84 sits atop the planar top surface 52 of the grate supporting members 50 of the frames 18, 20, and is held securely between the upper grate contacting members 60 of frames 18, 20.

If desired, after the concrete is cured, the nuts 78 may be removed from the bolts 76, and the sidewall and bracing assembly 10 may be separated from the frames 18, 20. This allows the sidewall and bracing assembly 10 to be reused.

A further option is the use of an elongated stabilizing bolt 92 extending from the outer surface 64. Of the upper grate contacting member 60, bottom surface 54 or the point of intersection between the two members 50, 60. This bolt 92, as seen in FIG. 5, becomes surrounded by concrete after final construction of the trench and acts to provide additional stability to the frame 18, 20. The bolt 92 may have a head 94 located at its outer end to provide even further stability.

What I claim is:

1. An adjustable frame for maintaining a grate in stable position relative to a second frame along a trench, comprising:

(a) a horizontal grate supporting member comprising:
  1. a generally planar top surface upon which the bottom of said grate rests;
  2. a bottom surface opposite said top surface;
  3. a rearward edge; and
  4. a forward edge opposite said rearward edge;
(b) an upper grate contacting member extending vertically upward from said top surface of said grate supporting member at said rearward edge of said grate supporting member for contacting a side of said grate; and
(c) a sidewall contacting surface extending vertically downward from said bottom surface of said grate supporting member at said forward edge of said grate supporting member for contacting a trench from sidewall, said sidewall contacting surface having adjustment slots through which fastening means can be place for adjusting both the vertical position and slope of the frame and selectively fastening said frame to said sidewall.

2. The frame of claim 1, wherein said upper grate contacting member is comprised of:

(a) a front surface which contacts said grate;
(b) a rear surface opposite said front surface; and
(c) a stabilizing bolt extending outwardly from said rear surface for providing additional stability to said frame when said frame is positioned along said trench.

3. The frame of claim 1, wherein said sidewall contacting surface comprises an upper edge attached to said grate supporting member forward edge and a lower edge opposite said upper edge; and wherein said adjustment slot begins at said lower edge and extends vertically in the direction of said upper edge.

4. The frame of claim 3, wherein said adjustment slot extends to a point approximately midway between said lower edge of said sidewall contacting member and said upper edge of said sidewall contacting member.

5. The frame of claim 1, and further comprising a stabilizing bolt extending from said bottom surface of said grate supporting member.

6. The frame of claim 1, and further comprising a stabilizing bolt extending outwardly from the point of intersection of said upper grate contacting member and said grate supporting member.

7. The frame of claim 2, wherein said frame is made of galvanized steel.

8. The frame of claim 1, wherein said fastening means is comprised of a bolt and nut combination.

9. An assembly for forming a trench covered by a grate comprising:

(a) a first sidewall having a lower edge for engaging the floor of said trench and an upper edge extending above said lower edge at the point where a first edge of said grate is desired to be held;

(b) a second sidewall having a lower edge for resting against the floor of said trench and an upper edge extending above said lower edge at a point where a second edge of said grate opposite said first grate edge is desired to be held, said second sidewall parallel to said first sidewall;

(c) a cross-support member attached at a first end to said first sidewall and at a second end opposite said first end to said second sidewall for maintaining said sidewalls in parallel relationship;

(d) a pair of adjustable grill mounting frames, each said frame comprising:

1. a horizontal grate supporting member comprising:

(a) a generally planar top surface upon which the bottom of said grate rests;

(b) a bottom surface opposite said top surface;

(c) a rearward edge; and (d) a forward edge opposite said rearward edge;

2. an upper grate contacting member extending vertically upward from said top surface of said grate supporting member at said rearward edge of said grate supporting member for contacting a side of said grate; and 3. a sidewall contacting surface extending vertically downward from said bottom surface of said grate supporting member at said forward edge of said grate supporting member for contacting said sidewall said sidewall contacting surface having a vertical adjustment slot through which an adjustable fastening means can be placed for adjustably fastening said frame to said sidewall; said first frame adjustably fastened atop said first sidewall so that the forward edge of its grate supporting member faces said second sidewall and said second frame adjustably fastened atop said second sidewall so that the forward edge of its grate supporting member faces said first sidewall so that said grate supporting members form a surface upon which said grate may rest.

10. A method of leveling a grate over a grate-covered trench using a trench-form having at least one sidewall upon which a grate supporting frame may be positioned and a first frame for supporting said grate having a sidewall contacting surface, said sidewall contacting surface having an elongate adjustment slot located thereon, comprising the steps of:

(a) forming a hole through said sidewall at a point along said sidewall corresponding to the location of said adjustment slot when said frame is positioned on said sidewall;

(b) positioning said frame on said sidewall so that said hole is in position corresponding to the position of said adjustment slot; and (c) placing fastening means through said hole and adjustment slot, said fastening means capable of being repeatedly tightened to firmly secure said frame to said sidewall and capable of being repeatedly loosened to allow adjustment of the position of said frame relative to said sidewall.

11. The method of claim 10, wherein said trench-form has a second sidewall parallel to said first sidewall, and further comprising the steps of:

(a) forming a hole through said second sidewall at a point along said second sidewall corresponding to the location of said second adjustment slot when said frame is positioned on said second sidewall;

(b) positioning a second frame similar to said first frame on said second sidewall so that said hole of second sidewall is in position corresponding to the position of adjustment slot of said second frame;

(c) positioning said second frame on said second sidewall so that said second hole is in position corresponding to the position of said adjustment slot of said second frame; and (d) placing fastening means through said second hole and said adjustment slot of said second frame, said fastening means being capable of being repeatedly tightened to firmly secure said second frame to said second sidewall and capable of being repeatedly loosened to allow adjustment of the position of said second frame relative to said second sidewall and said first frame.

12. The method of claim 10, wherein said adjustment slot extends vertically along said sidewall contacting surface to allow vertical adjustment of said frame.

13. The method of claim 10, wherein said frame comprises a plurality of said adjustment slots, and further comprising the steps of:

(a) forming a hole through said sidewall at each point along said sidewall corresponding to the location of each said adjustment slot when said frame is positioned on said sidewall; and (b) positioning said frame on said sidewall so that each of said holes are in position corresponding to the position of an adjustment slot; and (c) placing fastening means through each hole and each adjustment slot, said fastening means being capable of being individually and repeatedly tightened to firmly secure said frame to said sidewall and capable of being individually and repeatedly loosened to allow adjustment of the position of said frame relative to said sidewall at various points along the length of said trench-form.

14. The method of claim 10, wherein said fastening means is a bolt and nut combination.

15. The method of claim 11, wherein said fastening means is a bolt and nut combination.

16. The method of claim 10, and further comprising the steps of:

(a) placing a piece of material the approximate dimension of a grate on said frame to determine the need for adjusting the position of said frame;
(b) loosening said fastening means to allow said frame to be placed in proper position;
(c) placing said frame into proper position; and
(d) tightening said loosened fastening means to resecure said frame to said sidewall.

17. The method of claim 13, and further comprising the steps of:
(a) placing a piece of material the approximate dimension of a grate atop said first and second frames to determine the need for adjusting the positions of said frames;
(b) loosening the fastening means necessary to allow said frames to be placed into proper position;
(c) placing at least one of said frames into proper position; and
(d) tightening said loosened fastening means to resecure said frames to their respective sidewalls.

18. The method of claim 13, and further comprising placing a spreader bar between said first and second frames to maintain said frames at a desired distance.

19. The method of claim 13, and further comprising placing a number of spread bars between said first and second frames to further maintain said frames in relative parallel relationship and at a desired distance.

20. A method of constructing a grate covered trench comprising:
(a) placing a box-shaped bracing between a pair of trench-form sidewalls to hold said sidewalls in desired position to form a trench-form upon which a pair of grate supporting frames each having an elongate adjustment slot may be positioned;
(b) forming a hole through each said sidewall at a point along said sidewall corresponding to the location of said adjustment slot when said frame is positioned on said sidewall;
(c) positioning each frame on a sidewall so that each hole is in position corresponding to the position of each adjustment slot;
(d) placing fastening means through each hole and each adjustment slot to secure said frames to said sidewalls;
(e) placing said trench-form and frames in the location of said trench;
(f) adjusting each frame until said frames are in positions which allow said grate to rest in a desired position;
(g) tightening said fastening means to secure said frames in said positions which allow said grate to rest in a desired position; and
(h) surrounding said trench-form with material to hold said trench-form in final position.

21. The method of claim 20, wherein said material is cement, and comprising the step of removing said trench-form from said frames after the cement hardens leaving said cement to support said frames and grate.

* * * * *